US009097401B2

(12) United States Patent
Brendle

(10) Patent No.: US 9,097,401 B2
(45) Date of Patent: Aug. 4, 2015

(54) LIGHT MODULE FOR MOTOR-VEHICLE HEADLIGHT

(71) Applicant: Automotive Lighting Reutlingen GmbH, Reutlingen (DE)

(72) Inventor: Matthias Brendle, Tuebinger (DE)

(73) Assignee: AUTOMOTIVE LIGHTING REUTLINGEN GMBH, Reutlingen (DE)

( * ) Notice: Subject to any disclaimer, the term of this patent is extended or adjusted under 35 U.S.C. 154(b) by 84 days.

(21) Appl. No.: 13/867,041

(22) Filed: Apr. 20, 2013

(65) Prior Publication Data

US 2013/0294101 A1 Nov. 7, 2013

(30) Foreign Application Priority Data

Apr. 20, 2012 (DE) ..... 10 2012 206 602
Jun. 28, 2012 (DE) ..... 10 2012 211 144

(51) Int. Cl.
*F21S 8/10* (2006.01)

(52) U.S. Cl.
CPC ..... *F21S 48/1317* (2013.01); *F21S 48/1159* (2013.01); *F21S 48/12* (2013.01); *F21S 48/1364* (2013.01); *F21S 48/1747* (2013.01); *F21S 48/1266* (2013.01)

(58) Field of Classification Search
CPC ... F21S 48/1159; F21S 48/12; F21S 48/1266; F21S 48/1317; F21S 48/1364; F21S 48/1747
USPC ..... 362/487, 509, 518, 523, 544, 545
See application file for complete search history.

(56) References Cited

U.S. PATENT DOCUMENTS

| | | | | |
|---|---|---|---|---|
| 4,456,948 | A * | 6/1984 | Brun | 362/268 |
| 6,719,444 | B1 * | 4/2004 | Alber et al. | 362/518 |
| 7,387,417 | B2 * | 6/2008 | Sazuka et al. | 362/544 |
| 7,513,642 | B2 * | 4/2009 | Sormani | 362/245 |
| 2004/0223338 | A1 * | 11/2004 | Koike et al. | 362/545 |
| 2005/0041436 | A1 * | 2/2005 | Ishida | 362/518 |
| 2005/0094413 | A1 * | 5/2005 | Sazuka et al. | 362/544 |
| 2006/0007697 | A1 * | 1/2006 | Ackermann | 362/520 |
| 2007/0211487 | A1 * | 9/2007 | Sormani | 362/545 |
| 2007/0279924 | A1 * | 12/2007 | Yagi | 362/509 |
| 2007/0279927 | A1 * | 12/2007 | Yamamichi et al. | 362/545 |
| 2008/0316760 | A1 * | 12/2008 | Schug et al. | 362/516 |
| 2009/0027908 | A1 * | 1/2009 | Komatsu | 362/516 |

FOREIGN PATENT DOCUMENTS

| | | | |
|---|---|---|---|
| DE | 102007025337 | A1 | 12/2007 |
| JP | 2003031011 | A | 1/2003 |
| JP | 2009266710 | A * | 11/2009 |

* cited by examiner

*Primary Examiner* — Thomas A Hollweg
(74) *Attorney, Agent, or Firm* — Howard & Howard Attorneys PLLC

(57) ABSTRACT

A light module comprises a light-exit section, a base light source that exhibits at least one LED with a light-emitting surface limited by an edge, a reflector open to the light-exit section for collimating light on a meridional plane, and a cylinder lens for collimating the light on a sagittal plane running perpendicular to the meridional plane. The reflector on the sagittal plane is free of curvature and is curved on the meridional plane such that a focal line is defined. The base light source is arranged such that the edge runs on the focal line, and the light-emitting surface proceeds from the focal line extending in a direction of the light-exit section so that the light radiated from the light module exhibits a basic light distribution with a "light/dark" boundary.

13 Claims, 11 Drawing Sheets

LIGHT MODULE FOR MOTOR-VEHICLE HEADLIGHT

CROSS-REFERENCE TO RELATED APPLICATION

This application is based upon and claims priority to German Patent Application 10 2012 206 602.0 filed on Apr. 20, 2012 and German Patent Application 10 2012 211 144.1 filed on Jun. 28, 2012.

BACKGROUND OF INVENTION

1. Field of Invention

The invention relates to, in general, a light module and, in particular, such a light module for a motor-vehicle headlight.

2. Description of Related Art

In many cases, motor-vehicle headlights are supposed to provide a dimmed-light distribution that is characterized by a horizontally running "light/dark" boundary in sections. In the process, it is desirable to generate the most intensive possible illumination in the region directly below the "light/dark" boundary (dimmed-light/spot-light distribution) to achieve a sufficient range. In addition, a sufficient illumination of the front region of the vehicle or of lateral regions should be ensured (basic light distribution). Such motor-vehicle headlights can be used as passing lights or fog lights. In the process, a dangerous glare from oncoming traffic can be prevented by a suitable course of the "light/dark" boundary.

Moreover, often times with motor vehicles, a high-beam-light distribution should be provided additionally. The high-beam-light distribution exhibits high illumination intensity in a region above the "light/dark" boundary of the dimmed-light distribution.

On the one hand, projection systems for realization of a dimmed-light distribution are known. In this connection, it is usually a matter of two-stage optical systems in which the light of a light source is directed via a primary lens system into the focal plane of a secondary lens system, which projects light with the desired radiated-light distribution. On the basis of the two-stage structure, projection systems, as a rule, require a great deal of installation space along the beam path.

Furthermore, reflection systems are known in which case a reflector is employed for formation and redirection of the light radiated from a light source to the radiated-light distribution. In this connection, usually large reflector surfaces that are complex in shape are necessary to achieve the desired light distribution.

Often, the use of LEDs is desired as a light source for motor-vehicle headlights since the LEDs exhibit comparatively low energy consumption and a comparatively high efficiency of energy conversion. However, in this connection, there is a problem in that, according to the current state of the related art, LEDs usually generate lower light flows than gas-discharge lamps or halogen lamps. Therefore, at regular intervals, several LED-light sources must be combined into a light module to generate sufficiently high light flows.

Against this background, the invention addresses the problem of providing a compact LED light module with which a radiated-light distribution with high illumination intensity can be achieved at the "light/dark" boundary and homogenous illumination can be achieved with high efficiency. In the process, it should be possible, in particular, to integrate a "fog light" function in simple manner.

SUMMARY OF INVENTION

The invention overcomes problems in the related art in a light module for a motor-vehicle headlight. The light module comprises a light-exit section through which light can be emitted in a main direction of emission. In addition, a base light source is provided exhibiting at least one LED with a light-emitting surface limited by an edge. The light module additionally exhibits a reflector open to the light-exit section for collimation of the light on a sagittal plane running perpendicular to the meridional plane. In the process, the reflector on the sagittal plane is essentially designed to be free of curvature and is curved on the meridional plane such that a focal line is defined. The base light source is arranged such that the edge of the at least one LED runs on the focal line, and the light-emitting surface of the LED proceeds from the focal line running in the direction of the light-exit section so that light radiated from the light module exhibits a basic light distribution with a "light/dark" boundary.

Since the edge of the LED runs on the focal line and the light-emitting surface extends away from the reflector (that is, in the direction of the light-exit section), each light bundle radiated from the light-emitting surface that is reflected on a reflector section leads to an illuminated region that adjoins directly to the "light/dark" boundary and extends below the "light/dark" boundary. Thus, a basic light distribution is generated that exhibits a vertical dark region above and a vertical light region below, wherein the light region is separated from the dark region by the "light/dark" boundary.

In addition, the solution according to the invention is based on the idea of dividing the bundling effect in a vertical direction (that is, on the meridional plane) and in a horizontal direction (that is, on the sagittal plane) into two different components. Due to its curvature, the reflector causes only bundling in a vertical direction on the meridional plane whereas the cylinder lens is designed for bundling in a horizontal direction.

Since the reflector defines an expanded foe-al line, several LEDs of a base light source can be arranged along the focal line. Sufficient installation space is available for this purpose. Even when the individual LEDs are arranged at a distance from one another, the bundling through the cylinder lens can lead to a radiated-light distribution with a homogeneous course in a horizontal direction. The light module according to the invention can, thus, be supplied with power from several LEDs. In this way, high illumination intensity and great light flows can be achieved.

If the base light source includes several LEDs, as explained above, each LED leads to an illuminated region that adjoins directly to the "light/dark" boundary. All illuminated regions adjoin directly to the "light/dark" boundary. Thus, the "light/dark" boundary exhibits a high contrast, and the light region runs out homogeneously and continuously in the front region of the vehicle.

In the present context, "meridional" plane is understood as the plane that is stretched through the vertical direction and the main direction of emission. "Sagittal" plane is understood as the plane that is defined by the horizontal direction and the main direction of emission.

The cylinder lens can be designed as a cylindrical convergent lens or as a drum lens. Such lenses exhibit a convergent-lens cross-section in a section parallel with the sagittal plane (thus, are thicker in the middle than on the border) while the wall thickness in a section parallel with the meridional plane is constant. However, it is also conceivable that the cylinder lens is designed as a Fresnel lens exhibiting discrete lens zones that, in particular, are designed as wedge prisms. Such lenses require less material and can, therefore, be produced with lower weight.

The reflector exhibits in sections parallel with the meridional plane, in an embodiment, a parabolic course or a course similar to a parabolic-shape course so that a focal line running perpendicular to the meridional plane is defined.

The cylinder lens can be arranged before or after the reflector in the beam path proceeding from the base light source. An arrangement with two or more cylinder lenses is also conceivable, wherein a first cylinder lens is arranged before the reflector in the beam path proceeding from the base light source and a second cylinder lens is arranged after the reflector the beam path proceeding from the base light source. The cylinder lens can exhibit roller-like bundle structures, wherein, in particular, the roller axis runs parallel with the cylinder axis of the cylinder lens. The bundle structures are, for example, designed such that the cylinder lens and/or one of the named bundle structures appear(s) illuminated as a whole when looking into the light module. As a result of this, a daytime-running light with an attractive visual effect can be realized.

In an embodiment, the cylinder lens forms the light-exit section of the light module. To this end, in particular, the reflector is limited in the direction of the light-exit section by limiting edges, and the cylinder lens is designed such that it directly adjoins the limiting edges of the reflector.

The reflector can be designed as a segment or sector of a cylindrical hollow body. In this connection, the cylindrical body is not restricted to a circular cylinder. Rather, a general cylinder is conceivable in terms of a hollow body that arises by shifting a curve running on the meridional plane along a straight line perpendicular to the meridional plane.

Advantageously, the reflector extends only above the light-emitting surface of the LED. Since an LED only radiates light in a half-space above its light-emitting surface, in the case of the light module according to the invention, an extension of the reflector below the light-emitting surface can be dispensed with. This makes possible a compact structure of the light module. In an embodiment, the reflector viewed on the meridional plane from the focal line extends only above an angular region smaller than 120° (in particular, smaller than 90°).

For further development, the reflector exhibits a reflector facet and/or a scatter structure that areas designed such that a light bundle can be diverted from the reflector facet and/or the scatter structure to a region above the "light/dark" boundary of the basic light distribution. As a result, a small part of the intensity radiated from the base light source can be diverted as "overhead lighting" to the dark region above the "light/dark" boundary. This makes possible, for example, a reading of traffic signs without the risk of blinding the oncoming traffic. The reflector facet can be designed as a region of the reflector surface that exhibits an orientation deviating from the surrounding reflector surface. Also, a design is conceivable as an indentation or an elevation in the reflecting surface of the reflector.

The base light source is, in particular, designed such that a source-light distribution with a direction of emission can be radiated. The base light source can be arranged such that, with the main direction of the light module, its direction of emission encloses an acute deflection angle, a right angle, or an obtuse deflection angle. In this connection, a deflection angle is understood as the absolute amount of the angle that is enclosed from a first leg extending from a vertex in a direction of emission and a second leg that extends from the vertex to the main direction of emission. Deflection angles between 60° and 120° have proved to be advantageous. Via the deflection angle, it is possible to influence the intensity distribution of the basic light distribution of the light module. If the direction of emission of the base light source is tilted in the direction of the light-exit section (which corresponds to an acute deflection angle in terms of the above definition), a majority of the radiated light intensity is directed immediately below the "light/dark" boundary. As a result, high illumination intensity can be realized immediately below the "light/dark" boundary. If, conversely, the base light source is tilted such that the direction of emission with the main direction of emission encloses an obtuse angle (that is, the direction of emission is tilted away from the light-exit section), a greater portion of the light intensity is directed to regions far below the "light/dark" boundary. Thus, the intensities of the spot distribution of the passing light and of the basic light distribution can be calibrated.

In an embodiment, the base light source exhibits at least one LED with a plane-constructed light-emitting surface that is limited by straight running edges.

The base light source can exhibit a plurality of LEDs that are arranged next to one another such that, in each case, an edge of an LED lies on the focal line. In the process, each LED exhibits, in turn, a light-emitting surface limited by edges. In particular, the base light source includes a plurality of similar LED chips that are arranged immediately adjoining one another.

The individual LEDs or LED chips of the base light source can advantageously be electrically actuated independently from one another. This makes it possible to electrically modify the radiated-light distribution of the light module in a simple manner.

An embodiment of the light module arises as a result of the fact that a high-beam-light source is provided in addition to the base light source. The high-beam-light source, in turn, exhibits an LED with a light-emitting surface limited by an edge, wherein the high-beam-light source is arranged such that the focal line runs through the light-emitting surface. Then light can be emitted with the light module with a high-beam-light distribution that overlaps with the "light/dark" boundary of the basic light distribution. The combined high-beam-light/basic light distribution is then homogenous and does not exhibit any stripes on the transition between the two light distributions. The high-beam-light source can be arranged next to the base light source along the focal line without problems. There is sufficient installation space available for this purpose in the case of the light module according to the invention.

However, a high-beam-light distribution can also be provided as a result of having the edge of an LED of the high-beam-light source run on the focal line, but the light-emitting surface extends proceeding from the focal line in the direction opposite the light-exit section. In this respect, the light-emitting surfaces of LEDs of the base light source and of the high-beam-light source extend in opposing directions proceeding from the focal line. This embodiment leads to a high-beam-light distribution that does not overlap with the basic light distribution, but, rather, extends above the "light/dark" boundary of the basic light distribution.

The high-beam-light source can, in an embodiment, be electrically actuated separately from the base light source so that passing light and high beam can be switched on and off independently from one another.

The high-beam-light source can be further designed by the aforementioned measures explained with regard to the base light source. In this respect, reference is made to the statements on the base light source. In particular, it is conceivable that the high-beam-light source is designed identical to the base light source, but differs with respect to the arrangement relative to the focal line.

In an embodiment, a high-beam bundling lens is provided for bundling the light of the high-beam-light source on or parallel with the sagittal plane. The high-beam bundling lens is designed and arranged such that the light emitted from the base light source remains essentially uninfluenced. In this respect, only the high-beam light is bundled by the high-beam bundling lens. This makes it possible to radiate a high-beam-light distribution from the light module that is more strongly bundled in the horizontal direction than the basic light distribution. As a result, a high-beam-light distribution can be emitted in the manner of a spot placed on the basic light distribution above the "light/dark" boundary.

For further development, an optical prism can be provided. The optical prism is designed and arranged with reference to the high-beam-light source such that a light beam radiated from the high-beam-light source is deviated on or offset parallel with the meridional plane (however, remaining uninfluenced parallel with the sagittal plane). The function of the optical prism can be combined in advantageous manner with the high-beam bundling lens. With the optical prism, the optical position of the high-beam-light source can be virtually altered with reference to the focal line. This can be advantageous if, for reasons of space, the high-beam-light LED is supposed to be arranged such that the LEDs of the high-beam-light source and the LEDs of the base light source face one another with reference to the focal line. Then, the high-beam-light source can be virtually offset with the optical prism such that, from the view of the reflector, the focal line runs through the light-emitting surface of the high-beam-light source. Without the optical prism, such a position could not be easily realized with respect to the focal line. Rather, to this end, the high-beam-light source would have to be arranged offset along the focal line vis-à-vis the base light source since both components would otherwise overlap on the focal line.

For further development, a diaphragm with a diaphragm edge is provided that is arranged such that the edge (which limits the light-emitting surface of the LED of the base light source and/or of the high-beam-light source) is defined by the diaphragm edge. As a result, a sharp boundary of the light-emitting surface can be achieved (which, in the case of the light module, leads to a "light/dark" boundary that is rich in contrast).

The light sources of the light module are, in an embodiment, arranged symmetrically to the meridional plane so that a radiated-light distribution can be achieved with the focus of intensity on the meridional plane. In particular, the cylinder lens is designed mirror-symmetrical to a symmetrical plane running perpendicular to the sagittal plane (the LEDs of the base light source and/or of the high-beam-light source with respect to this symmetrical plane). As a result, the light distribution radiated by the light module exhibits a focus of light on the symmetrical plane.

The cylinder lens is, in an embodiment, designed such that a focal line running perpendicular to the sagittal plane is defined, wherein the cylinder lens is arranged such that the base light source and/or the high-beam-light source are/is arranged between the focal line and the cylinder lens. In particular, the cylinder lens, in the process, exhibits a great focal distance such that the focal line opposite the main direction of emission lies far behind the base light source. With this configuration, the light on the sagittal plane is only weakly collimated. A stronger collimation can be desired, for example, for the realization of a daytime-running light. In this case, the cylinder lens can exhibit a short focal distance, and the focal line of the cylinder lens can run nearly in the region of the base light source or through the base light source.

For further development, the cylinder lens can exhibit cylindrical scatter structures each of which exhibits a cylinder axis and, in particular, is designed in the style of a section of a cylinder lens. In an embodiment the cylinder axes of the scatter structures and the cylinder axis assigned to the cylinder lens run parallel with and are perpendicular to the sagittal plane.

Other objects, features, and advantages of the light module of the invention are readily appreciated as the light module becomes more understood while the subsequent detailed description of at least one embodiment of the light module is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

In the following description, identical or matching components have the same reference numbers.

Figure 1A:
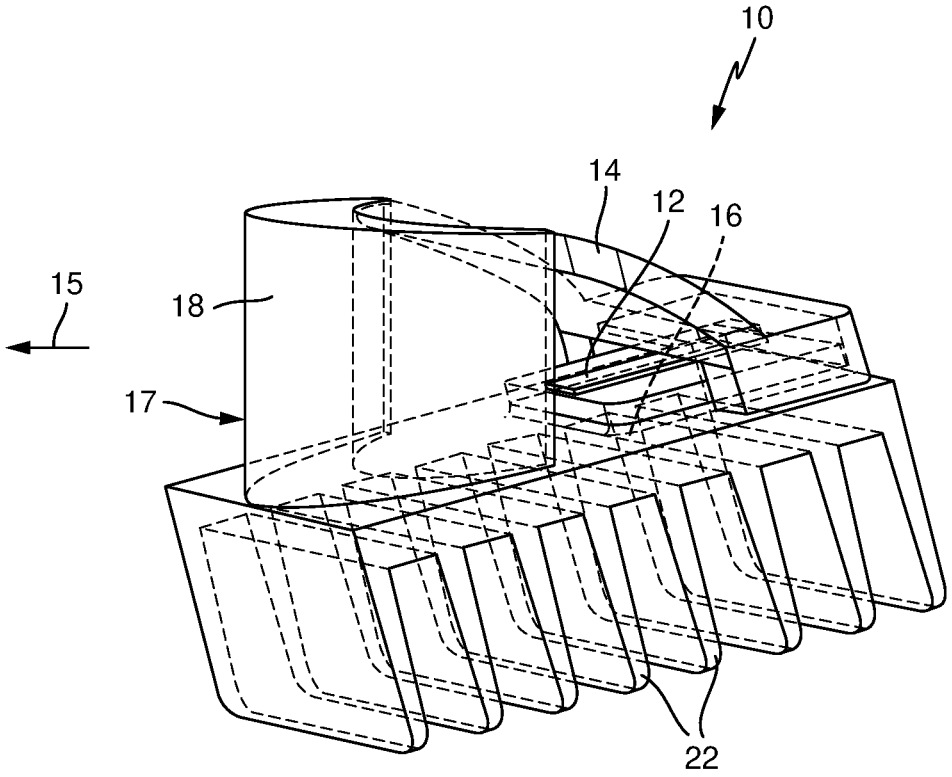
FIG. 1A shows an embodiment of a light module according to the invention in perspective view.

FIG. 1 shows the structure of an embodiment of a light module 10 according to the invention in perspective view. The light module 10 exhibits a base light source 12 and a reflector 14. The reflector 14 is designed open in a main direction of emission. Light can be radiated in the main direction of emission 15 through a light-exit section 17 of the light module 10.

The reflector 14 is concavely curved on a meridional plane stretched from the main direction of emission 15 and the vertical direction. It is designed in the manner of a segment of a cylindrical hollow body. The reflector 14 is arranged on a cooling body 16 exhibiting a plurality of cooling, ribs 22.

The light module 10 additionally exhibits a cylinder lens 18 that is arranged in the beam path proceeding from the base light source 12 to the reflector 14. In the embodiment shown, the light-exit section 17 includes the cylinder lens 18 of the light module 10.

Figure 1B:
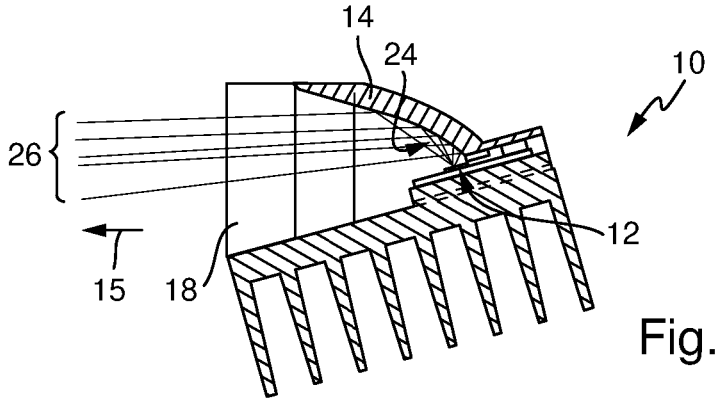
FIG. 1B shows the embodiment of the light module illustrated in FIG. 1A in longitudinal section.

FIG. 1*b* shows the light module 10 in a section through the meridional plane. A pencil of light rays 24 radiated through the base light source 12 is diverted by the reflector 14 to a radiated-light distribution 26 that, due to the curvature of the reflector 14 on the meridional plane to a great extent, exhibits collimated light rays.

Figure 1C:
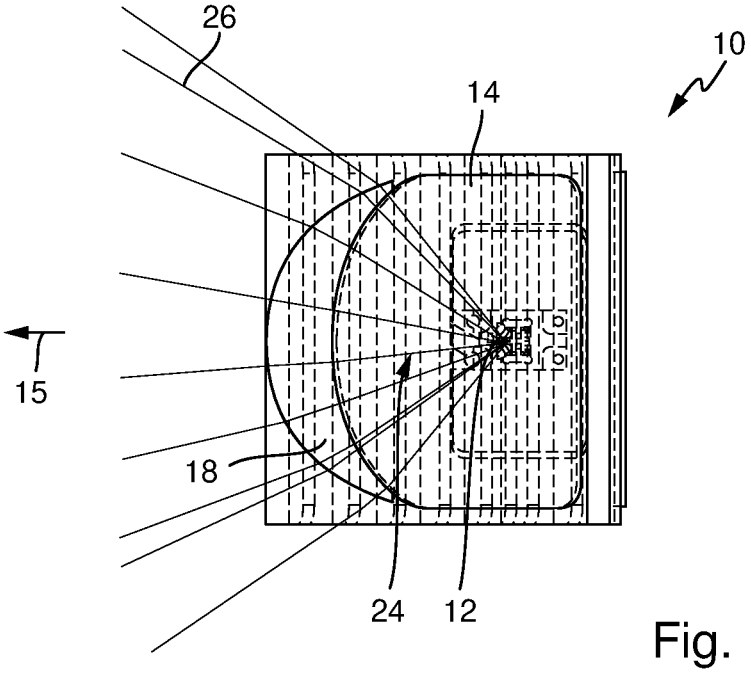
FIG. 1C shows the embodiment of the light module illustrated in FIG. 1A in horizontal section.

The effect of the cylinder lens 18 is illustrated in FIG. 1*c*, which shows the light module 10 in a section through a sagittal plane stretched from the main direction of emission 15 and the horizontal direction. Obviously, the cylinder lens 18 bundles a pencil of the light rays 24 exclusively in horizontal direction (that is, on the sagittal plane).

As can be seen in FIG. 1*c*, the cylinder lens 18 exhibits a convergent lens cross-section in the horizontal section. The cylinder lens 18 has a constant wall thickness in each section parallel with the meridional plane. The cylinder lens 18 has a focal distance and a focal line running on the meridional plane assigned to it. In the embodiment shown, the cylinder lens 18 collimates the light radiated from the base light source 12 on the sagittal plane only weakly since the focal distance assigned to the cylinder lens 18 is very much greater than the distance of the base light source 12 from the cylinder lens 18. In this respect, the focal line assigned to the cylinder lens 18 opposite the main direction of emission 15 is far behind the base light source 12. For further development, the cylinder lens 18 can exhibit wavy or cylindrical bundle structures on at least one lens surface. The bundle structures extend along the vertical direction (that is, perpendicular to the sagittal plane).

Figure 2A:
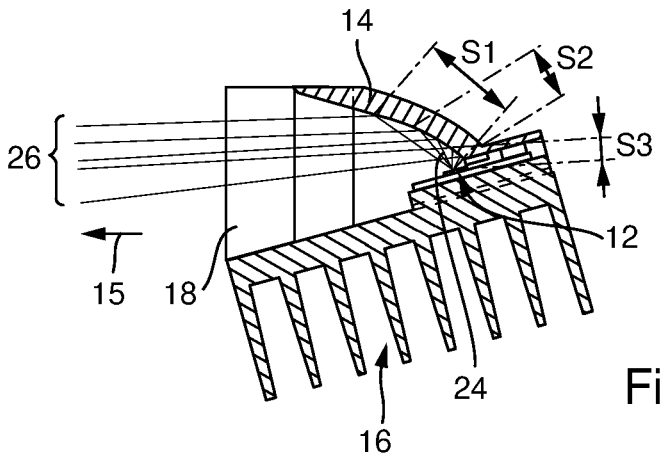
FIGS. 2A and 2B show schematic representations of the light module in longitudinal section for explanation of the basic light distribution.

With the assistance of FIGS. 2*a* through 2*c*, the origin of the basic light distribution of the light module 10 is explained below.

In its course, on the meridional plane, the reflector 14 exhibits essentially a parabolic shape. Therefore, the reflector 14 defines a focal line 20 that extends on the sagittal plane (cf. FIG. 2*b*, which shows a schematic longitudinal section perpendicular to the sagittal plane). In FIG. 2*a*, light rays are indicated that are reflected at different reflection points of the reflector 14. The reflection points exhibit different distances S1, S2, S3 (focal intercept S1, S2, S3) from the focal line 20. Illuminated regions of the radiated-light distribution 26 are assigned to the reflections at reflection points with different focal intercepts S1, S2, S3. The illuminated regions directly adjoin to a "light/dark" boundary of the radiated-light distribution 26. This is explained in greater detail below with the help of FIG. 2*b*.

To this end, a base light source 12 is considered that is designed as a planar LED and exhibits a light-emitting surface 11 that is limited by two opposing edges 13, 13'. The base light source 12 is arranged such that the edge 13 runs on the focal line 20 of the reflector 14, and the light-emitting surface 11 proceeds from the focal line extending essentially in the main direction of emission 15. Therefore, light rays that come from the edge 13 of the base light source 11 are reflected from the reflector 14 in light rays running essentially parallel. On the other hand, the light rays radiating from the opposing edge 13' fall at the respective reflection points (S1, S2, S3) under a greater angle to the reflection surface of the reflector 14 than the light rays radiating from the edge 13. Therefore, the light rays radiating from the edge 13' are directed from the reflector 14 to a region that lies vertically below the light beams radiating from the edge 13.

Figure 2B:
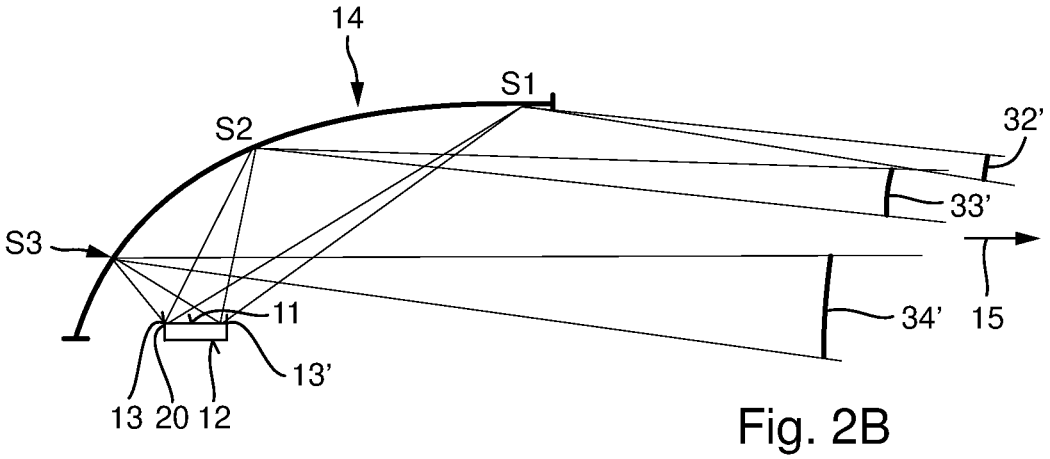
Figure 2C:
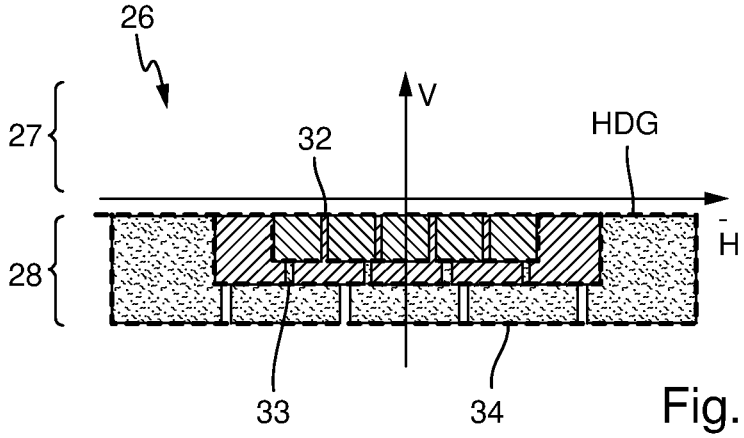
FIG. 2C shows a schematic representation of the radiated-light distribution in a test screen spaced away from the light module.

If the radiated-light distribution 26 is observed on a test screen that is stretched at a distance from the light module 10 in a main direction of emission 15, the image for the intensity distribution shown schematically in FIG. 2*c* results. All light rays radiating from the edge 13 fill (for approximately great distances of the test screen from the light module) along a line running horizontally on the test screen. This line forms the "light/dark" boundary HDG of the radiated-light distribution 26. Above the "light/dark" boundary HDG, the radiated-light distribution 26 exhibits a dark region 27 to which an illuminated light region 28 adjoins below the "light/dark" boundary HDG. The vertical height at which the light rays radiating from the edge 13' fall on the test screen depends on the distance S1, S2, S3 of the respective reflection point. Thus, the reflected rays proceeding from the edge 13' at a small distance S3 from the focal line are diverted to a region lying vertically far below the "light/dark" boundary HDG. By way of contrast, the light rays radiating from the edge 13' that are reflected at a great distance S1 from the focal line 20 on the reflector 14 are deflected to a region directly below the "light/dark" boundary HDG.

Therefore, in the representation of FIG. 2*b*, the different reflection points have different pencils of light assigned in distances S1, S2, S3. The pencil of light 32', which is limited by the reflected light rays (radiating from edges 13, 13') in the great distance S1, exhibits a small divergence angle. The reflected pencil of light 34' at a small distance S3 from the focal line 20, on the other hand, exhibits a comparatively large divergence angle. Reflection at the reflection point with medium distance S2 leads to a pencil of light 33' with a medium divergence angle.

In the representation of FIG. 2*c*, illuminated zones (light-source images) 32-34 are assigned to the pencils of light 32'-34'. In this connection, it is assumed that (five) further identical LEDs adjoin to the LED shown in FIG. 2*b* in longitudinal section. It can be recognized that reflection at reflection points with great distance (S1) from the focal line 20 lead to small illuminated surfaces 32. By way of contrast, reflection at reflection points with low distance (S3) from the focal line 20 leads to large illuminated surfaces 34. The overlapping of all reflected light bundles at different regions of the reflector 14, therefore, results in a radiated-light distribution 26, which exhibits a high illumination intensity in the region of the "light/dark" boundary HDG and runs continuously and out below the "light/dark" boundary HDG.

In the case of the base light source 12, in an embodiment, an arrangement with several LEDs is employed. The base light source 12 so developed radiates light with a source light distribution that exhibits an intensity maximum in a direction of emission 40. This is schematically shown in the sectional, display shown in FIG. 3*a* (section through the meridional plane).

The absolute amount of the angle that is enclosed between a leg in the main direction of emission 15 and a leg in the direction of emission 40 proceeding from an imaginary vertex defines a deflection angle $\alpha$. The size of the deflection angle $\alpha$ determines the intensity distribution of the radiated-light distribution 26 below the "light/dark" boundary HDG in a representation corresponding to FIG. 2*c*. If the base light source 12 is tilted such that the direction of emission 40 is tilted in the direction of the main direction of emission 15 of the light module (which corresponds to an acute deflection angle α according to the above definition), the greater portion of the light intensity radiated from the base light source 12 is reflected from reflector regions at a great distance from the focal line 20 (compare FIG. 2*b*). This results in the greater portion of the radiated light intensity of the base light source 12 being deflected to the region directly below the "light/dark" boundary HDG (small light-source images 32). Hence, the light module in the configuration shown in FIG. 3*a* supplies a basic light distribution with intensive illumination directly below the "light/dark" boundary, which continuously runs out vertically downward.

Figure 3A:
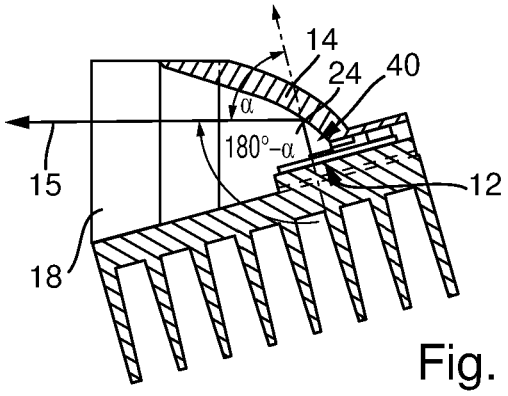
FIGS. 3A and 3B show the light module in longitudinal section for explanation of the beam path.
Figure 3B:
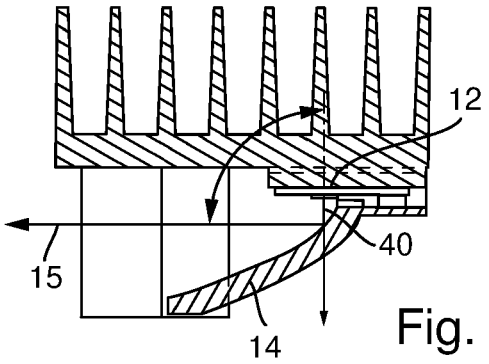

In FIG. 3*b*, the base light source 12 is tilted away from the main direction of emission 15 vis-à-vis FIG. 3*a* so that the main direction of emission 15 and the direction of emission 40 enclose a right angle. This leads to a greater portion of the light intensity radiated from the base light source 12 being reflected from reflector regions close to the focal line 20 (compare FIG. 2*b*) and being directed to regions further below the "light/dark" boundary The light module then supplies a radiated-light distribution 26 with more uniform illumination below the "light/dark" boundary HDG (compare FIG. 2*c*).

Figure 4A:
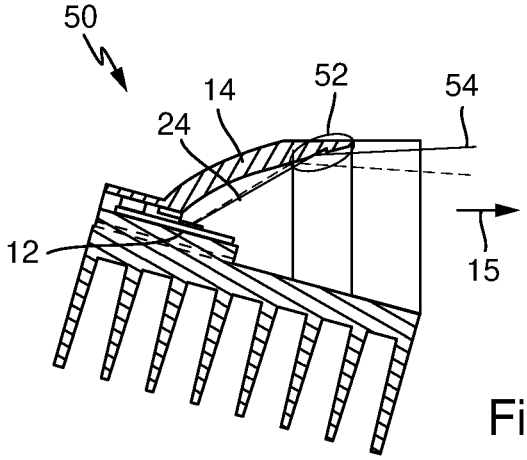
FIG. 4A shows a further embodiment of a light module according to the invention.

The light module 50 shown in FIG. 4*a* differs from the light modules previously explained in that the reflector 14 exhibits a reflector facet 52. The reflector facet 52 is formed by a spatially limited section of the reflection surface of the reflector 14. The section is designed tilted vis-à-vis the adjoining reflecting surface (i.e., locally exhibiting an orientation deviating from the surrounding reflection surface). Therefore, a pencil of light 24 falling on the reflector facet 52 is reflected under a different angle from light rays that are reflected from the regions of the reflector 14 surrounding the reflector facet 52.

Figure 4B:
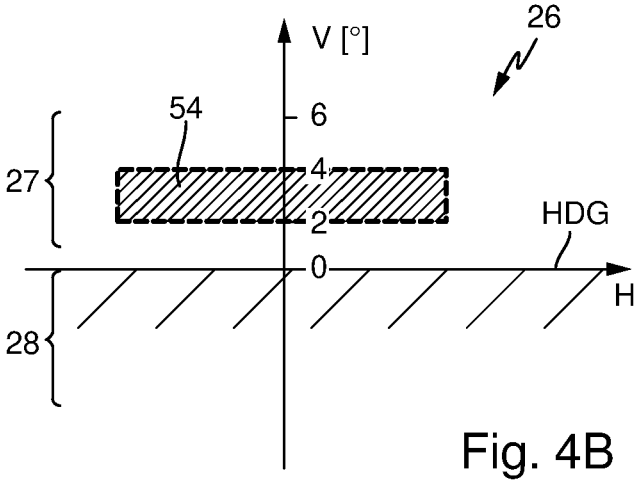
FIG. 4B shows a schematic representation for explanation of the radiated-light distribution of the embodiment of the light module illustrated in FIG. 4A.

This leads to a radiated-light distribution 26 as illustrated in FIG. 4*b*. Due to the reflector facet 52, an overhead-light distribution 54 is generated in the dark region 27. In comparison with the radiated-light distribution 26, this exhibits only to low intensity in the light region 28 and, for example, makes possible a reading of street signs. The angle under which the overhead-light distribution is radiated above the "light/dark" boundary HDG can be adjusted by suitable design of the reflector facet 52. For example, an angle in the range of 2° to 4° is conceivable.

Figure 5A:
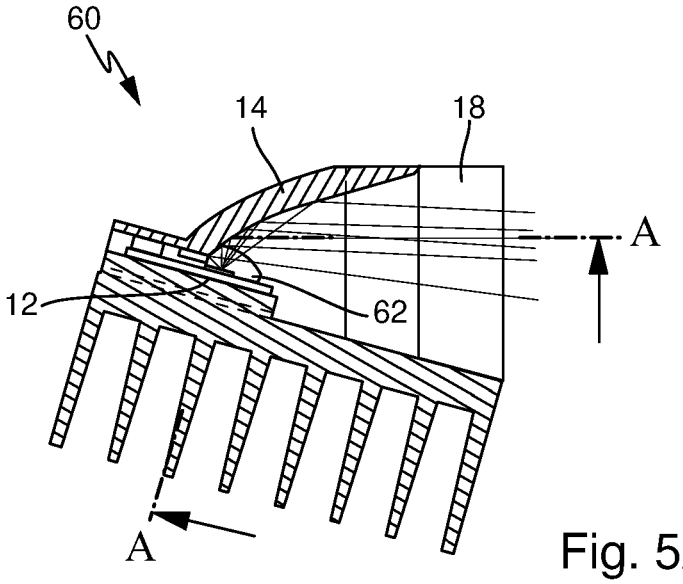
FIG. 5A shows a further embodiment of a light module according to the invention in longitudinal section.
Figure 5B:
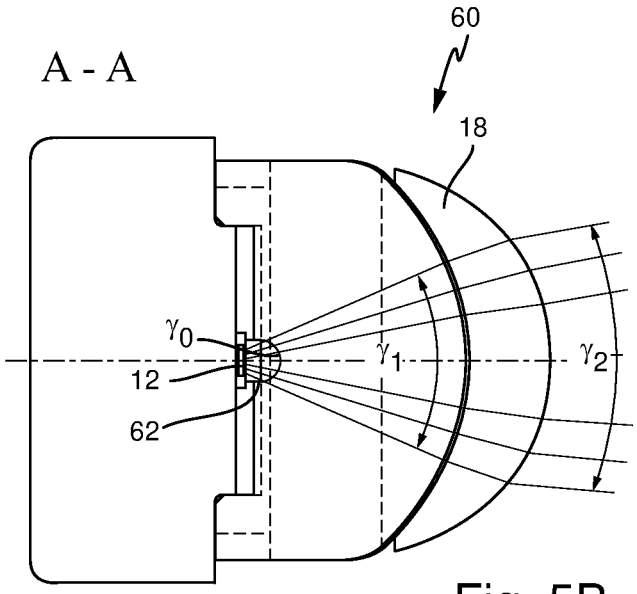
FIG. 5B shows the embodiment of the light module illustrated in FIG. 5A in horizontal section.

In FIGS. 5*a* and 5*b*, a light module 60 is described that exhibits, in addition to the cylinder lens 18 (referred to hereinafter as "first cylinder lens 18"), a second cylinder lens 62. In the process, the second cylinder lens 62 is arranged in the beam path proceeding from the base light source 12 in front of the reflector 14, and the first cylinder lens 18 is arranged in the beam path after the reflector 14.

As can be recognized in FIG. 5*b*, the second cylinder lens 62 bundles the light radiated from the base light source 12 (source-light distribution γ0) parallel with the sagittal plane (in a horizontal direction) first to an intermediate light distribution γ1. The first cylinder lens 18 restricts this intermediate light distribution γ1 in the foregoing described manner further in a horizontal direction so that a radiated-light distribution γ2 with a decreased divergence angle is radiated on the sagittal plane.

Notwithstanding the foregoing example, a convergent lens can also be provided in place of the second cylinder lens 62. This convergent lens can be designed such that it not only bundles light on the sagittal plane, but also on the meridional plane (that is, horizontally and vertically). As a result, the light distribution emitted from the base light source 12 is already restricted before the reflector 14 and the first cylinder lens 18. It is likewise conceivable to design the lens 62 as a drum lens.

Figure 6A:
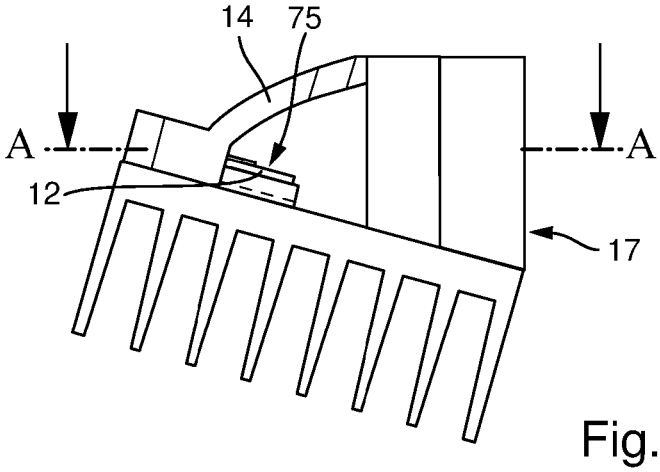
FIG. 6A shows a further embodiment of a light module according to the invention in longitudinal section.
Figure 6B:
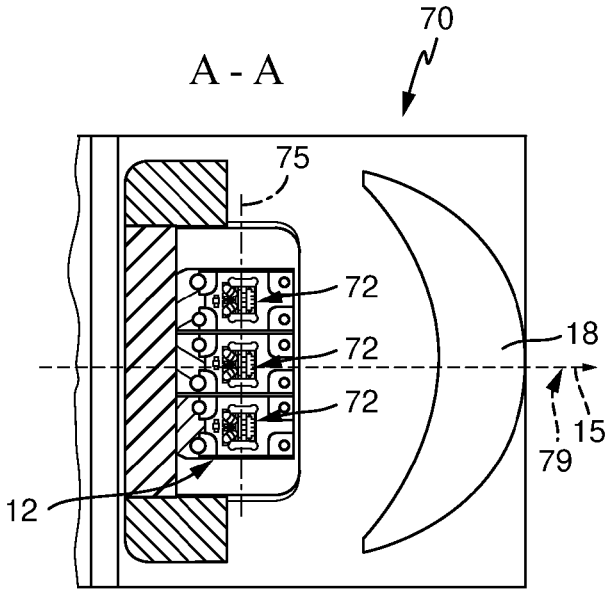
FIG. 6B shows the embodiment of the light module illustrated in FIG. 6A in horizontal section.

FIGS. 6*a* and 6*b* show a light module 70 in sectional views through the meridional plane and parallel with the sagittal plane. In the case of the light module 70, the base light source 12 includes several module light sources 72 that are arranged offset to one another along a focal line 75 of the reflector 14.

Figure 6C:
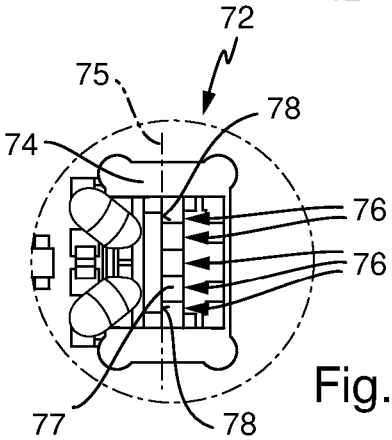
FIG. 6C shows a detailed view from FIG. 6B.

According to the detailed representation in FIG. 6*c*, each module light source 72 exhibits a carrier circuit board 74 upon which a plurality of LED chips 76 are arranged next to one another. Each LED chip 76 exhibits a square light-emitting surface 77 that is limited by edges 78. The LED chips 76 form a linear array, wherein, in each case, parallel-running edges of adjacent LED chips 76 run directly next to one another.

Each of the module light sources 72 of the base light source 12 is arranged, in respect to the reflector, such that, in each case, an edge 78 of an LED chip 76 runs on the focal line 75 and the light-emitting surface 77 extends in the direction of the light-exit section 17 of the light module 70.

The module light sources 72 have the property that light is radiated exclusively in a half-space above the carrier circuit board 74 with a direction of emission perpendicular to the light-emitting surface 77.

In the horizontal section shown in FIG. 6*b*, it can be recognized that the cylinder lens 18 is designed mirror-symmetrical to a symmetrical plane 79, which is stretched from the vertical direction and the main direction of emission 15. The base light source 12 is likewise designed mirror-symmetrical to this symmetrical plane 79 (i.e., the module light sources 72 are arranged symmetrically to the symmetrical plane 79).

Figure 7:
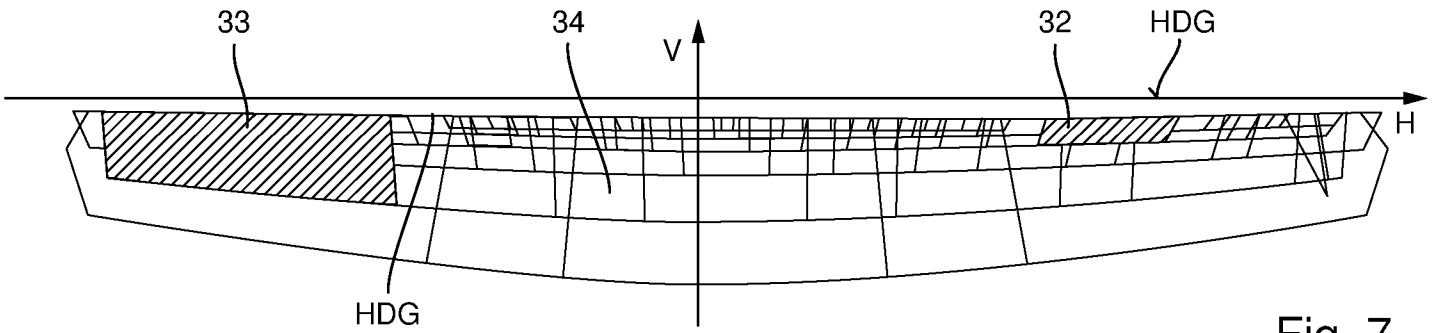
FIG. 7 shows a schematic representation for explanation of the basic light distribution in, the region of the "light/dark" boundary.

With the assistance of FIG. 7, the emitted-light distribution generated from the light module 70 shown in FIGS. 6*a* through 6*c* is explained (as can be observed on a test screen spaced apart from the light module 70 in the main direction of emission 15). The test screen extends perpendicular to the main direction of emission 15. Since, for each LED of each module light source 72, an edge 78 limiting the respective light-emitting surface runs on the focal line 75, the emitted-light distribution exhibits a "light/dark" boundary HDG (as explained previously for FIGS. 2*b* and 2*c*). In turn, reflections at regions of the reflector 14 with differing distances to the focal line 75 lead to illuminated, regions 32-34, each of which directly adjoins the "light/dark" boundary and extends vertically downward.

Figure 8A:
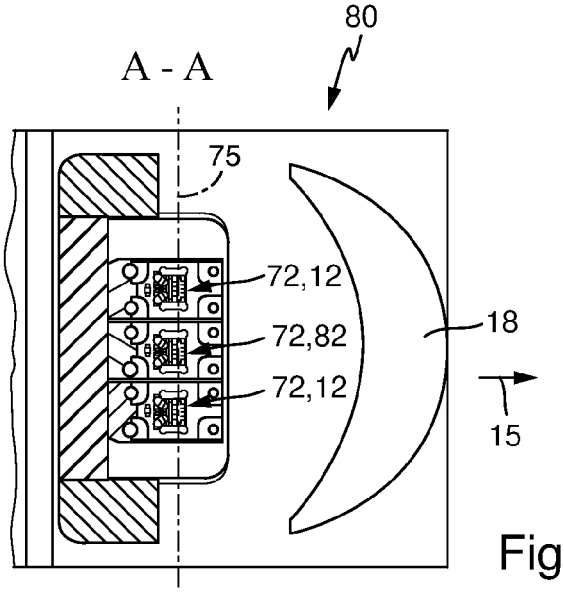
FIG. 8A shows a further embodiment of a light module according to the invention in horizontal section.
Figure 8B:
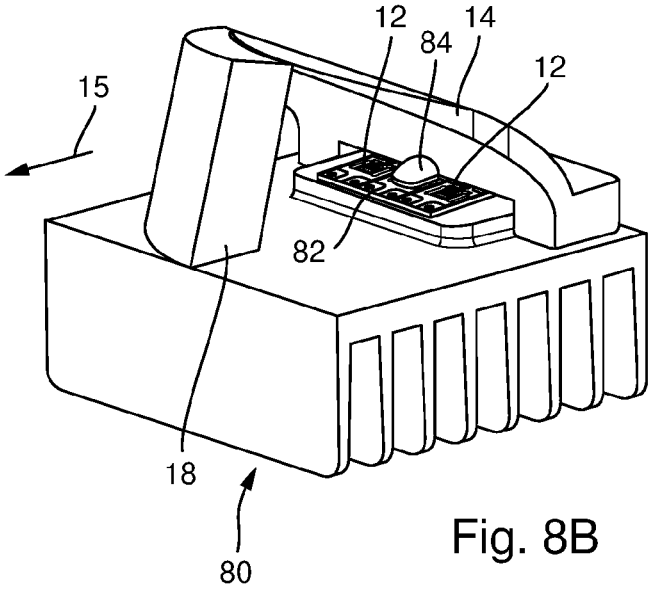
FIG. 8B shows the embodiment of the light module illustrated in FIG. 8A in perspective view.

FIGS. 8*a* and 8*b* show a light module 80 with which also a high-beam-light function can be provided. As can be recognized in the horizontal section shown in FIG. 8*a*, three module light sources 72 are arranged offset to one another along the focal line 75. With regard to the focal line 75, the two exterior module light sources 72 exhibit an arrangement as described for FIGS. 6*b* and 6*c*. In this respect, they jointly form a base light source 12. The center module light source 72 is arranged offset vis-à-vis the exterior module light sources 72 in the direction opposite the main direction of emission 15. This central module light source 72 forms a high-beam-light source 82.

Figure 8C:
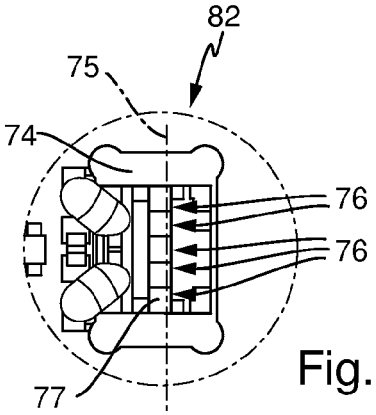
FIG. 8C shows a detailed view from FIG. 8A.

The arrangement of the high-beam-light source 82 is explained in greater detail with the assistance of FIG. 8*c*. The central module light source 72 exhibits, in turn, several LED chips 76 with square light-emitting surfaces and limitation through edges in the foregoing described manner (compare FIG. 6*c*). The module light source 72 forming the high-beam-light source 82 is, however, arranged such that the focal line 75 runs through the light-emitting surface 77 of the LEDs.

In the perspective view of light module 80 in FIG. 8*b*, it can be recognized that a high-beam-light-bundle lens 84 is provided only for the high-beam-light source 82. The high-beam-light-bundle lens is arranged directly on the carrier circuit board 74 of the module light source 72 forming the high-beam-light source 82. The high-beam-bundle lens 84 is designed as a drum lens such that the light emitted from the high-beam-light source 82 is horizontally bundled. However, it is also conceivable that the high-beam-light-bundle lens 84 is designed as a convergent lens that bundles the light emitted from the high-beam-light source 82 into at least two spatial directions perpendicular to one another. The light emitted from the exterior module light sources 72 (which form the base light source 12) is not deflected by the high-beam-bundle lens 84. The common cylinder lens 18, however, acts both on the light distribution emitted from the base light source 12 as well as on the light distribution emitted from the high-beam-light source 82.

With the light module 80, an emitted-light distribution can be achieved that is explained in greater detail below with the assistance of FIGS. 9*a* through 9*c*. Since the focal line 75 runs through the light-emitting surface 77 of the LEDs of the high-beam-light source 82, the high-beam-light source 82 illuminates a region that overlaps the "light/dark" boundary HDG and also extends above the "light/dark" boundary. This is desirable in the case of a high-beam-light distribution.

Figure 9A:
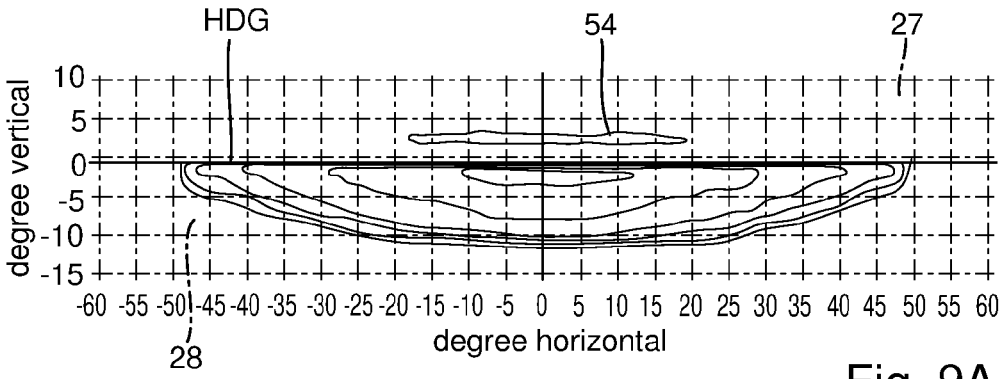
FIGS. 9A and 9C show a schematic representation for explanation of the basic light distribution and high-beam-light distribution.

FIG. 9*a* shows the emitted-light distribution when only the base light source 12 is being operated in the case of the light module 80. In the process, it is assumed that the reflector 14 exhibits a reflector facet 52 corresponding to the explanation for FIG. 4*a*. Hence, the emitted-light distribution exhibits a light region 28 as well as a dark region 27. In the dark region 27, an overhead-light distribution 54 of comparatively low intensity is generated by the reflector facet 52.

Figure 9B:
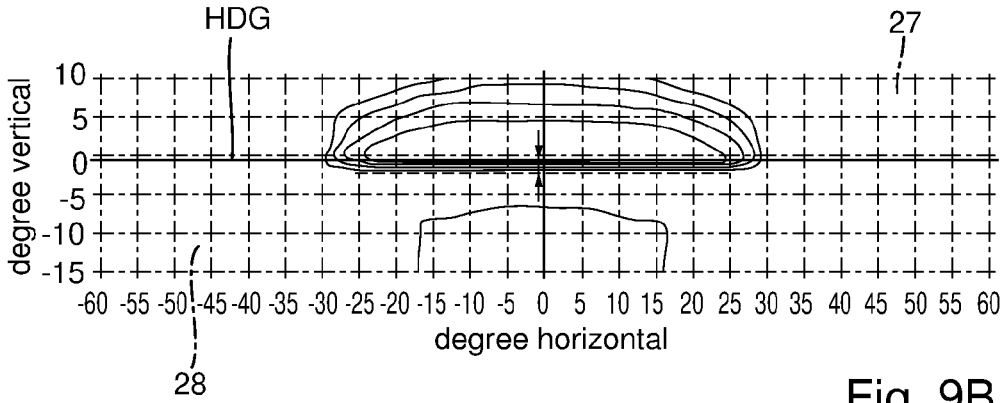

FIG. 9*b*, on the other hand, shows only the high-beam-light distribution of the light module. The high-beam-light distribution is generated when only the high-beam-light source 82 is operated. A majority of the light radiated from the high-beam-light source 82 is directed to the dark region 27 and overlaps the "light/dark" boundary. Since the high-beam-light-bundle lens 84 is also active for the high-beam-light source 82 along with the cylinder lens 18 (FIG. 8*b*), the high-beam-light distribution shown in FIG. 9*b* exhibits a lower horizontal expansion than the basic light distribution shown in FIG. 9*a*.

Figure 9C:
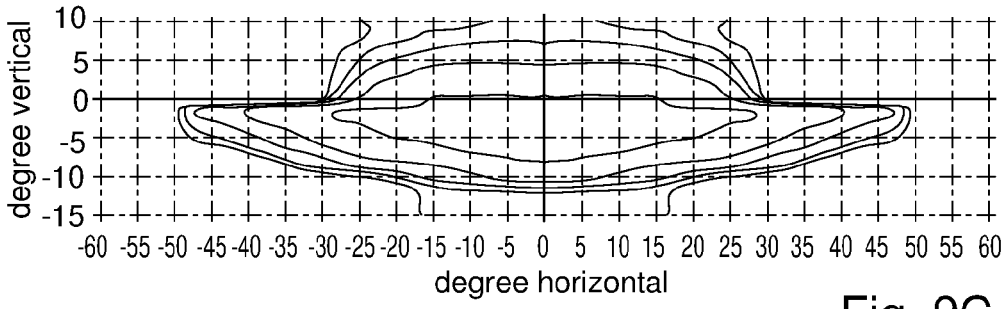

Finally, FIG. 9*c* shows a superposition of the light distributions shown in FIG. 9*a* and FIG. 9*b*. The light distributions are generated in the case of joint operation of the base light source 12 and the high-beam-light source 82.

Figure 10:
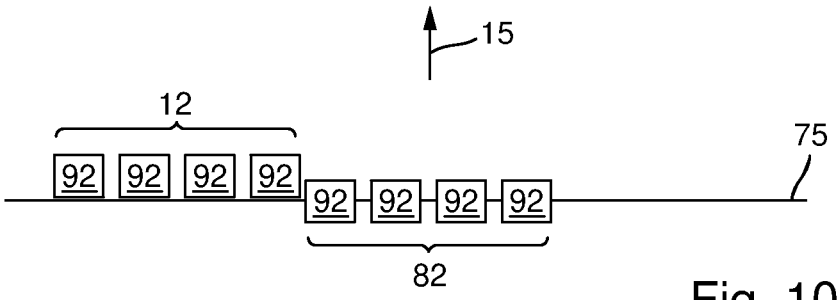
FIG. 10 shows a schematic representation for arrangement of the basic light source and the high-beam-light source.

FIG. 10 outlines the arrangement of the individual LED-light sources for the realization of a dimmed-light distribution and a high-beam-light distribution with a light module according to the invention. In FIG. 10, the focal line 75 as well as several elementary light sources 92 are indicated. An elementary light source 92 can, for example, be a module light source 72 of the above-described type, an individual LED, or an LED chip.

Four of the elementary light sources 92 are grouped into a base light source 12. The elementary light sources 92 of the base light source 12 are arranged such that limiting edges of the elementary light sources 92 run on the focal line 75.

Four additional elementary light sources 92 are grouped into a high-beam-light source 82. Their elementary light sources 92 are arranged offset vis-à-vis the base light source 12 along the focal line 75 such that the light-emitting surfaces of the elementary light sources 92 of the high-beam-light source 82 overlap the focal line 75.

The necessary installation space for the arrangement shown in FIG. 10 can be reduced by arranging the elementary light sources 92 of the high-beam-light source 82 with respect to the focal line 75 opposite the elementary light sources 92 of the base light source 12. In the process, edges of elementary light sources 92 of the base light source 12 run on the focal line 75. The elementary light sources 92 of the high-beam-light source 82 are each arranged in pairs opposite the elementary light sources 92 of the base light source 12 with respect to the focal line 75. This situation is shown in FIG. 11*a*.

Figure 11A:
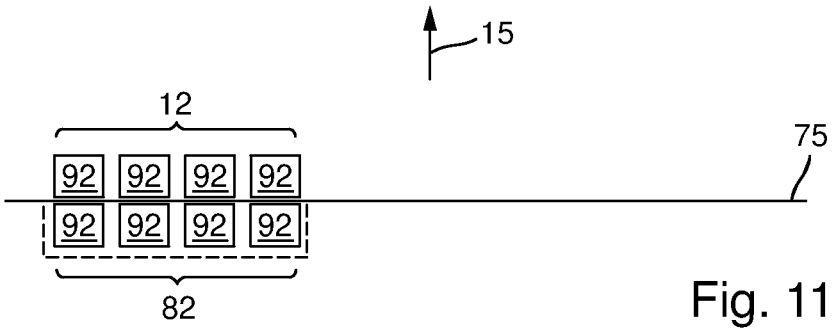
FIG. 11A shows a schematic representation for a further embodiment of a light module according to the invention for the arrangement of the basic light source and the high-beam-light source.

In this respect, all elementary light sources 92 in FIG. 11*a* are arranged in the style of a two-dimensional array of elementary light sources 92. If, in the ease of this arrangement, the focal line 75 runs along limiting edges of the elementary light sources 92 of the base light source 12, the focal line 75 cannot simultaneously run through the light-emitting surfaces of the elementary light sources 92 of the high-beam-light source 82.

Figure 11B:
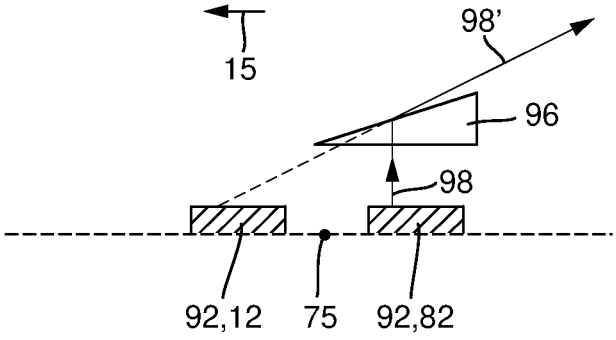
FIG. 11B shows the arrangement illustrated in FIG. 11A in lateral representation.

However, to generate a high-beam-light distribution in the manner of FIG. 9*b*, an optical prism 96 can be provided in the case of the arrangement shown FIG. 11*a*. The optical prism 96 is positioned assigned to the high-beam-light source 82 (as shown in lateral view in FIG. 11*b*). In the process, the optical prism 96 is, for example, designed as a wedge prism, which extends along the array from elementary light sources 92 of the high-beam-light source 82 arranged offset in a direction perpendicular to the sagittal plane. Through the wedge prism 96, a light bundle 98 emitted from the high-beam-light source 82 can be deflected such that the resulting light bundle 98' is virtually radiated from a position lying in the region of the base light source 12 (indicated by a dashed line in FIG. 11*b*).

It is conceivable to integrate the wedge prism 96 in a high-beam-bundle lens 84 (compare FIG. 8*b*). However, a convergent lens can also be used in place of the wedge prism 96. The convergent lens virtually magnifies the respective elementary light source 92 of the high-beam-light source 82 such that, from the view of the reflector 14, an overlapping with the focal line 75 occurs.

The different light sources (LEDs) can be advantageously actuated independently from one another. In this way, for example, a dimming of one or more of the individual light sources is possible (for example, pulse-width-modulation actuation).

For further development of the light modules according to the invention, an adjustment device can be provided with which the base light source 12 and/or the high-beam-light source 82 can be displaced with respect to the focal line 20, 75 of the reflector 14. This makes it possible to compensate production tolerances and calibrate the radiated-light distribution. More specifically, the adjustment device is designed such that the base light source 12 and/or the high-beam-light source 82 can be displaced parallel with the sagittal plane (in particular, perpendicular to the focal line 20, 75).

It should be appreciated by those having ordinary skill in the related art that the light module (10, 50, 60, 70, 80) has been described above in an illustrative manner. It should be so appreciated also that the terminology that has been used above is intended to be in the nature of words of description rather than of limitation. It should be so appreciated also that many modifications and variations of the light module (10, 50, 60, 70, 80) are possible in light of the above teachings. It should be so appreciated also that, within the scope of the appended claims, the light module (10, 50, 60, 70, 80) may be practiced other than as specifically described above.

What is claimed is:

1. A light module (10, 50, 60, 70, 80) for a motor-vehicle headlight, the light module (10, 50, 60, 70, 80) comprising:

a light-exit section (17) through which light can be radiated in a main direction of emission (15);

a base light source (12) that exhibits at least one LED (76) with a light-emitting surface (77) limited by an edge (13, 78);

a reflector (14) open to the light-exit section (17) for collimating the light on a meridional plane; and a cylinder lens (18) for collimating the light on a sagittal plane running substantially perpendicular to the meridional plane, wherein the reflector (14) is free of curvature in the sagittal plane and curved on the meridional plane such that a focal line (20, 75) is defined, the base light source (12) is arranged such that the edge (13, 78) runs on the focal line (20, 75), and the light-emitting surface (77) proceeds from the focal line (20, 75) extending in a direction of the light-exit section (17) so that the light (26) radiated from the light module exhibits a light distribution with a "light/dark" boundary (HDG).

2. The light module (10, 50, 60, 70, 80) according to claim 1, wherein the cylinder lens (18) is arranged in a beam path proceeding from the base light source (12) either of before and after the reflector (14).

3. The light module (10, 50, 60, 70, 80) according to claim 1, wherein the cylinder lens (18) forms the light-exit section (17) of the light module (10, 50, 60, 70, 80).

4. The light module (10, 50, 60, 70, 80) according to claim 1, wherein the reflector (14) is either of a segment and a sector of a substantially cylindrical hollow body.

5. The light module (10, 50, 60, 70, 80) according to claim 1, wherein the reflector (14) extends only above the light-emitting surface (77).

6. The light module (10, 50, 60, 70, 80) according to claim 1, wherein the reflector (14) exhibits at least one of a reflector facet (52) and a scatter structure such that a light bundle can be diverted to a dark region (27) above the "light/dark" boundary (HDG).

7. The light module (10, 50, 60, 70, 80) according to claim 1, wherein the base light source (12) radiates a source-light distribution with a direction of emission (40) and is arranged such that, with the main direction of emission (15), the direction of emission (40) encloses any of an acute deflection angle ($\alpha$), an obtuse deflection angle ($\alpha$), or a substantially right angle.

8. The light module (10, 50, 60, 70, 80) according to claim 1, wherein the base light source (12) exhibits a plurality of LEDs (76) that are arranged next to one another such that, in each case, an edge (78) of each of the LEDs (76) lies on the focal line (20, 75).

9. The light module (10, 50, 60, 70, 80) according to claim 1, wherein a high-beam-light source (82) is provided that exhibits at least one of the at least one LED (76) with the light-emitting surface (77) limited by the edge (78) and the high-beam-light source (82) is arranged such that the focal line (20, 75) runs through the light-emitting surface (77).

10. The light module (10, 50, 60, 70, 80) according to claim 9, wherein a high-beam bundle lens (84) for bundling the light of the high-beam-light source (82) is provided either of on and substantially parallel with the sagittal plane and the high-beam bundle lens (84) is arranged such that the light radiated from the base light source (12) remains substantially uninfluenced.

11. The light module (10, 50, 60, 70, 80) according to claim 9, wherein an optical prism (96) is provided such that a light beam (98) radiated from the high-beam-light source (82) is deviated either of on and offset substantially parallel with the meridional plane and remains substantially uninfluenced substantially parallel with the sagittal plane.

12. The light module (10, 50, 60, 70, 80) according to claim 9, wherein the cylinder lens (18) is substantially minor-symmetrical to a substantially symmetrical plane (79) running substantially perpendicular to the sagittal plane and the at least one LED (76) of at least one of the base light source (12) and high-beam-light source (82) is arranged substantially symmetrically with respect to the symmetrical plane (79).

13. The light module (10, 50, 60, 70, 80) according to claim 9, wherein a focal line running substantially perpendicular to the sagittal plane is defined and the cylinder lens (18) is arranged such that at least one of the base light source (12) and high-beam-light source (82) is arranged between the focal line and cylinder lens (18).

* * * * *